US005437296A

United States Patent [19]

Citino

[11] Patent Number: 5,437,296

[45] Date of Patent: Aug. 1, 1995

[54] SELF-CONTAINED MOBILE HEAT EXCHANGE TUBE BUNDLE CLEANING DEVICE

[75] Inventor: Robert Citino, Salem, Ohio

[73] Assignee: Pure Oil Engineering & Consultants Company, Salem, Ohio

[21] Appl. No.: 255,944

[22] Filed: Jun. 7, 1994

[51] Int. Cl.[6] ..... B08B 3/02

[52] U.S. Cl. ..... 134/108; 134/111; 134/144; 134/153

[58] Field of Search ..... 134/108, 111, 144, 148, 134/152, 153, 200

[56] References Cited

U.S. PATENT DOCUMENTS 2,685,293 8/1954 Dauphinee et al. ..... 134/153
3,052,245 9/1962 Nagle ..... 134/144
3,060,064 10/1962 Zingg ..... 134/144 X
3,225,777 12/1965 Shelton et al. ..... 134/144 X
3,487,840 1/1970 Stenzel et al. ..... 134/153 X
3,703,905 11/1972 Ice, Jr. ..... 134/144
4,509,544 4/1985 Mains, Jr. ..... 134/144
5,018,544 5/1991 Boisture et al. ..... 134/111

*Primary Examiner*—Philip R. Coe
*Attorney, Agent, or Firm*—Harpman & Harpman

[57] ABSTRACT

A mobile heat exchange tube bundle cleaning apparatus in which a truck trailer contains a tube bundle receiving reservoir that rotates and sprays partially submerged tube bundles with cleaning fluid from multiple fixed spray nozzles. The apparatus further comprises a trailer mounted cleaning fluid reservoir with pumps and filters to re-circulate cleaning fluid after it is sprayed onto the rotating tube bundles within the receiving reservoir.

13 Claims, 5 Drawing Sheets

SELF-CONTAINED MOBILE HEAT EXCHANGE TUBE BUNDLE CLEANING DEVICE

BACKGROUND OF THE INVENTION

1. Technical Field

This device relates to apparatus used to clean heat exchange tube bundles which are normally associated with power plants on site.

2. Description of Prior Art

Prior art devices of this type have relied on a variety of different configurations which address the problems of cleaning heat exchange tube bundles used for the transfer of heat in cooling oil which circulates around the exterior of the tube bundles while cold fluid is circulating within. Deposits are formed on the exterior surfaces of the bundle tubes due to the heat of cooling oil which must be removed in order to maintain efficient operation. The tube bundles are periodically removed and cleaned usually off site.

Ideally, the heat exchange tube bundles are cleaned on site which requires a mobile operation that can position and clean the tube bundles in a mobile self-contained environmentally isolated setting. Prior art examples of heat exchange tube bundle cleaners can be seen in U.S. Pat. Nos. 3,052,245, 3,060,064, 4,509,544 and U.S. Pat. No. 5,018,544.

In U.S. Pat. No. 3,052,245 an apparatus for cleaning heat exchanger tube bundles is disclosed wherein a bundle supporting cradle is shown to position and rotate the tube bundle while a bifurcated spray nozzle construction travels longitudinally back and forth spraying the rotating tube bundle.

U.S. Pat. No. 3,060,064 is directed towards a device that supports a heat exchanger tube bundle at opposite ends with a multiple nozzle spray carriage traveling longitudinally back and forth and vertically up and down on one side of the tube bundle. High pressure pumps direct a high velocity stream of fluid against the bundle as it is rotated.

Pat. No. 5,018,544 claims an apparatus for cleaning heat exchanger tube bundles having a mobile configuration in which a mobile crane and a bundle support and stabilization trailer receives tube bundles on outriggers extending from the truck having a series of rollers for rotation of the bundles and outside cleaning.

Finally, in U.S. Pat. No. 3,212,511 a portable drum cleaning machine is disclosed which is cited for showing an enclosed spray transport device. Garbage cans are cleaned by spinning and spraying on the interior and exterior while in an enclosed cleaning area.

SUMMARY OF THE INVENTION

A self-contained mobile heat exchanger tube bundle cleaning apparatus that partially submerges heat exchange tube bundles within a reservoir of cleaning fluid and simultaneously rotates the tube bundles and sprays their exterior surface from multiple fixed spray nozzles. Recirculation and filtering of the cleaning fluid from an onboard reservoir assures a constant source of clean fluid pumped under pressure to multiple spray nozzles. The heat exchanger tube bundles are enclosed within the reservoir isolating them and the cleaning process from the environment.

DESCRIPTION OF THE PREFERRED EMBODIMENT

Figure 1:
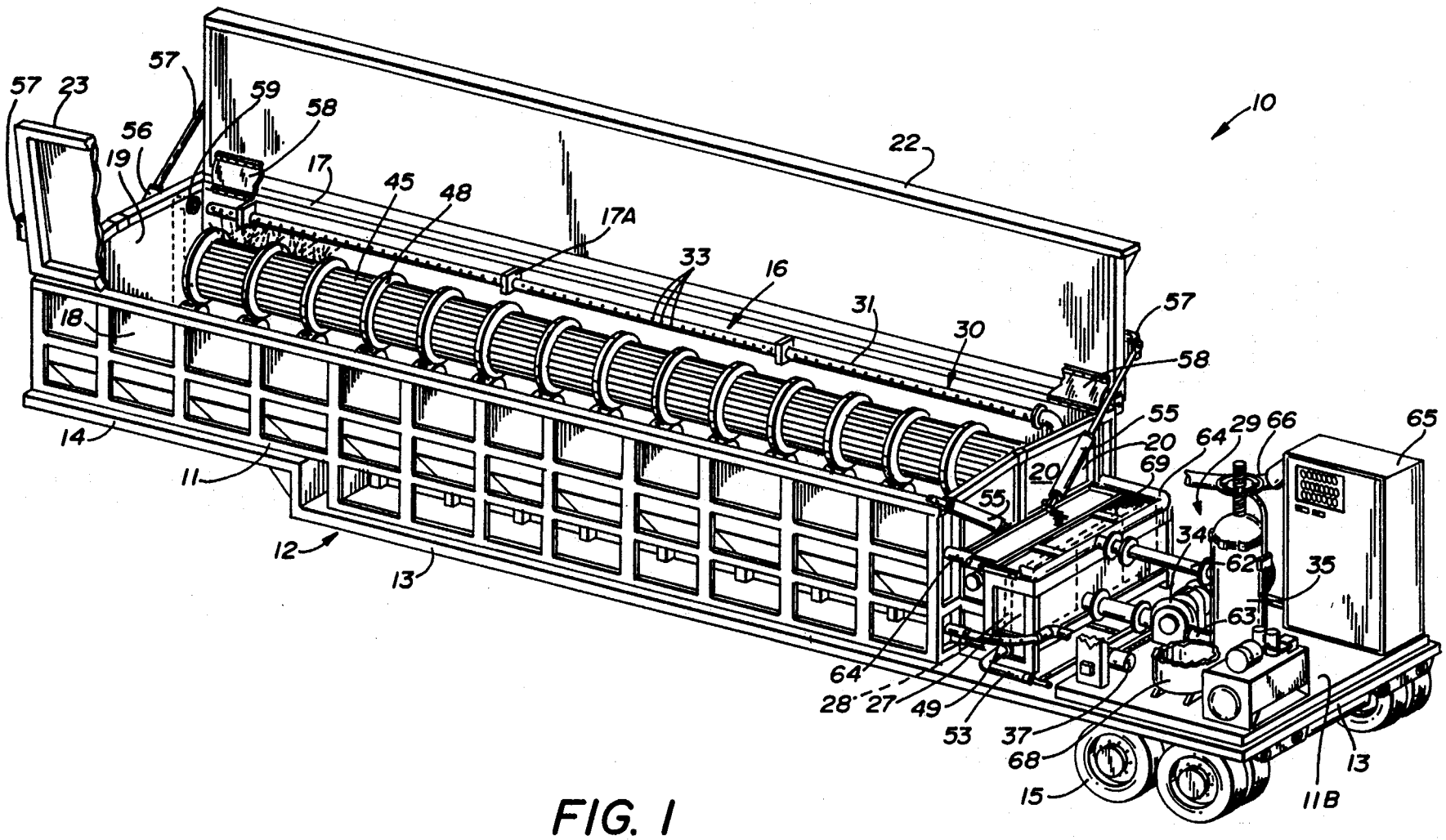
FIG. 1 is a perspective view of a portion of the heat exchanger tube bundle cleaning device illustrating a mobile reservoir with portions broken away.

Referring to FIGS. 1–4 of the drawings, a mobile self-contained heat exchanger tube bundle cleaning device 10 can be seen having a mobile base 11 mounted on a trailer configuration 12 having a bed 13 and a trailer hitch portion 14 with associated wheel assemblies 15 thereon.

The mobile base 11 includes a main tube bundle receiving reservoir enclosure 16 having spaced oppositely disposed sidewalls 17 and 18 integral respective end walls 19 and 20 and an interconnected bottom structure 21. The main tube receiving reservoir enclosure 16 has a pair of elongated doors 22 and 23 that are pivotally secured to the upper edges of said respective opposing sidewalls 17 and 18. Each of said doors have multiple frame elements and pivot inwardly towards one another forming an enclosed cleaning area within the bundle receiving reservoir enclosure 16 at 24.

A cleaning fluid supply reservoir 25 is positioned directly below a portion of said bottom structure 21 of the bundle receiving reservoir enclosure 16 defining an elongated rectangular tank, see FIGS. 4, 5 and 6 of the drawings. The cleaning fluid supply reservoir 25 is positioned centrally to the tube bundle receiving reservoir enclosure 16 thereabove and supplies all of the cleaning fluid required in the mobile self-contained configuration. A plurality of heating elements 25A are positioned in spaced longitudinal relation within the cleaning fluid supply reservoir 25 for heating of a cleaning fluid solution within to operational temperatures of approximately 140 degrees Fahrenheit. This is required for proper operation since the cleaning fluid is comprised of two components which in an unheated state tend to separate. A typical formulation for the cleaning fluid would be 85% DTE light oil and 15% Mobilsola® flushing oil.

A recirculation and filter sump 27 is positioned directly adjacent the respective ends of said main tube bundle receiving reservoir enclosure 16 and the cleaning fluid supply reservoir 25. The recirculation and filtering sump 27 is in direct communication with the main reservoir 16 for receiving used cleaning fluid therefrom. The recirculation and filter sump 27 has multiple particle filter screens 28 positioned within for initial fluid filtering of the used cleaning fluid within the recirculation system.

A main pump and filter assembly 29 are on a secondary mobile base 11B which is positioned on the trailer bed 13 adjacent to and in communication with the recirculation and filter sump 27 to provide cleaning fluid under pressure to a spray nozzle assembly 30 within said main tubular bundle receiving reservoir enclosure 16.

Figure 3:
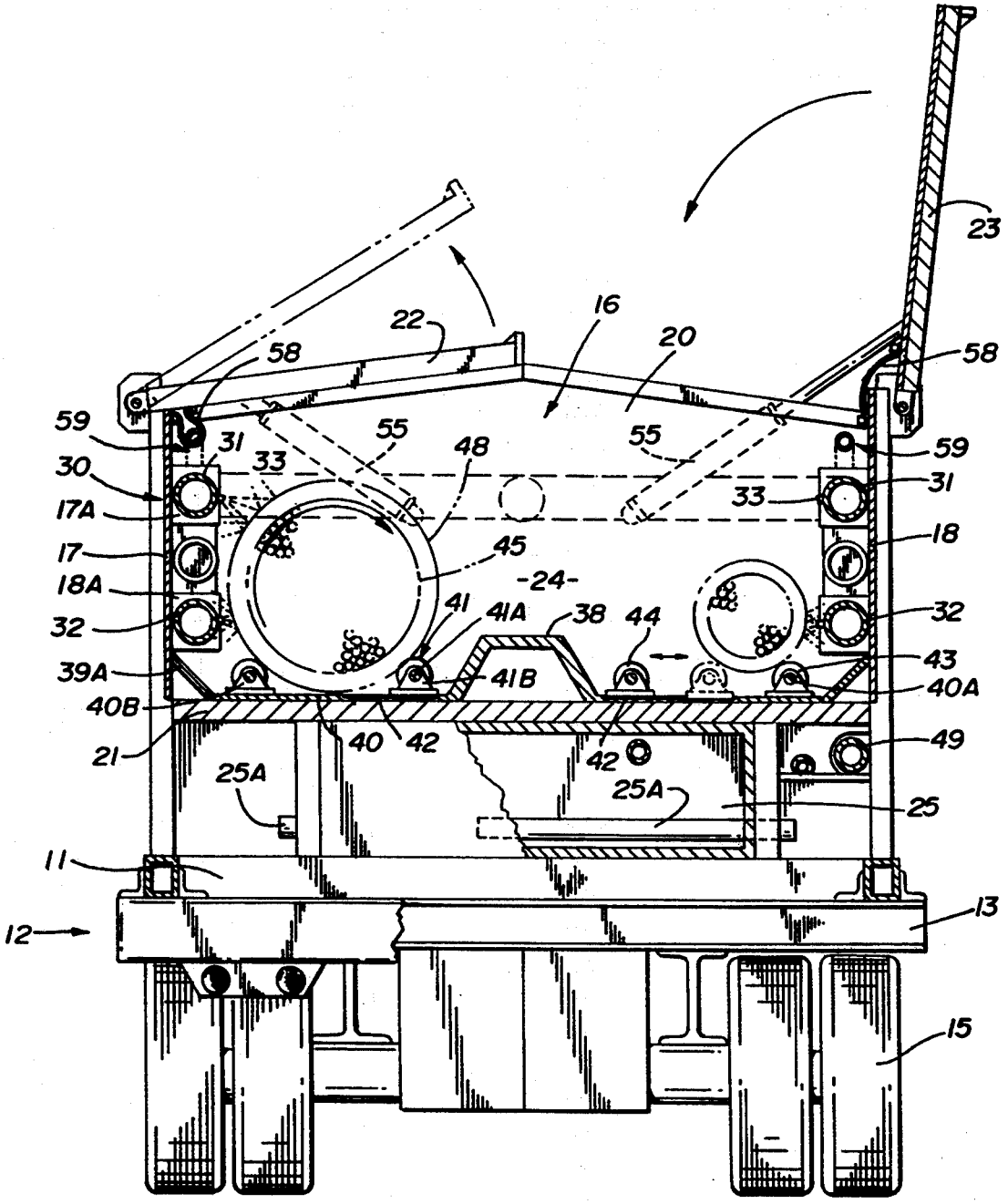
FIG. 3 is an end cross-sectional view of the heat exchanger tube bundle cleaning device illustrating heat exchanger tube bundles shown in broken lines positions within during use.

The spray nozzle assembly 30 includes pairs of nozzle support and supply manifolds 31 and 32 extending in spaced parallel relation to one another along said respective sidewalls 17 and 18 by adjustable manifold support brackets 17A and 18*a*, best seen in FIG. 3 of the drawings.

Each of the supply manifolds have a plurality of fixed longitudinally spaced inwardly facing spray nozzles 33 therein forming an overlapping two level spray pattern within the heat exchanger tube bundle receiving reservoir enclosure 16. The supply manifolds 31 and 32 can be rotated on their longitudinal axis within the adjustable manifold support bracket 17A and 18A so that the relative positioning of the nozzles 33 can be directed and repositioned in relation to the main tube bundle receiving reservoir enclosure 16. The pump and filter assembly 29 includes a pump 34 and a high volume filter 35 interconnected thereto by supply lines 36 and associated valving as will be well known to those skilled in the art.

Figure 5:
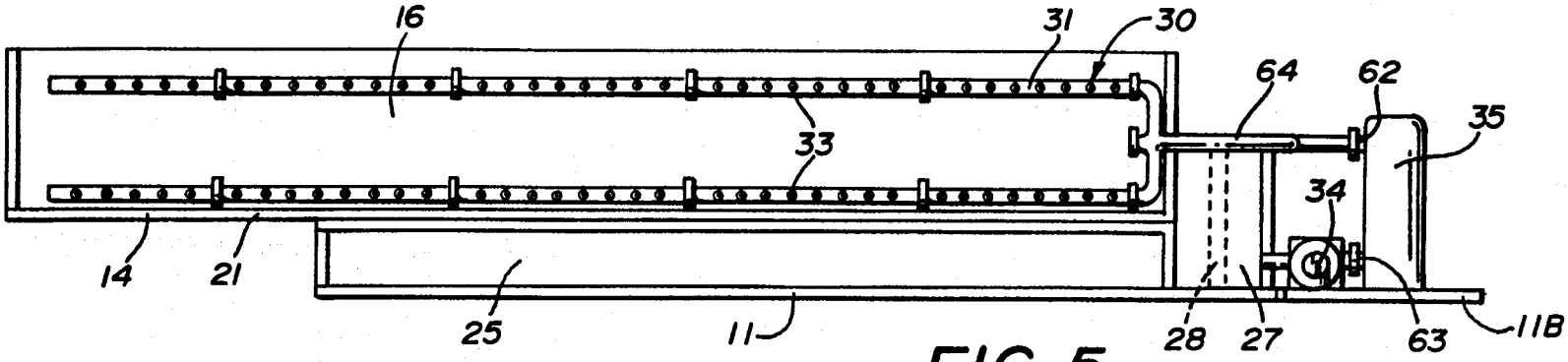
FIG. 5 is a graphic illustration of the heat exchanger tube bundle cleaning device showing the relative relationship of the associated reservoirs and circulation pumps, etc.

A secondary pump assembly 37 is used to initially fill the heat exchanger tube bundle receiving reservoir enclosure 16 and the recirculation and filtering sump 27 from the cleaning fluid supply reservoir 25 as best seen in FIG. 5 of the drawings.

Referring back to FIGS. 1–3 of the drawings, it will be seen that the bottom of the heat exchanger tube bundle receiving reservoir enclosure 16 is divided into two tube bundle support areas TSA by an elongated raised center portion 38. Each of the tube bundle support areas TSA have a drive roller assembly 40 and a guide roller assembly 41 within. Each of said respective guide roller assemblies can be adjusted transversely within said tube bundle support area TSA by moving within respective guide channels 42 towards and away from the elongated raised center portion 38 best seen in FIGS. 3 and 4 of the drawings.

Figure 4:
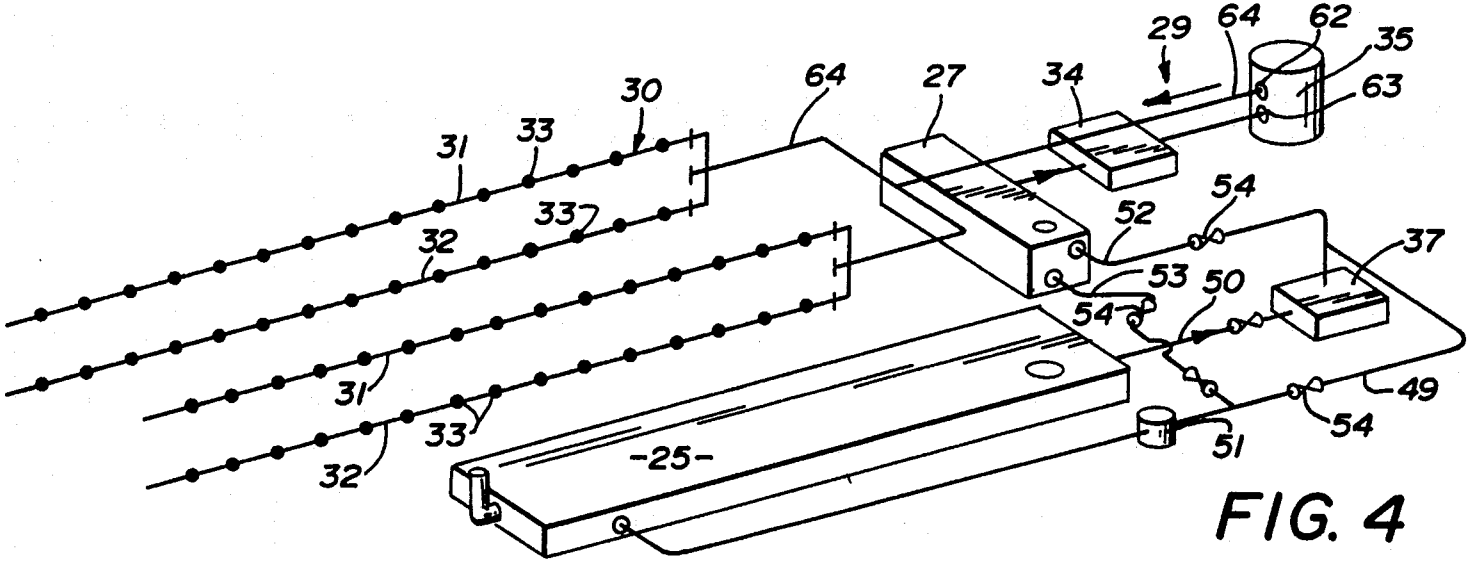
FIG. 4 is a graphic perspective schematic illustration of the cleaning fluid flow path and associated pumping and filtering apparatus and spray nozzles within the invention.

Each of the longitudinally spaced guide channels 42 extend between sidewall angles 39A and the raised center section 38 so that each of the guide roller assemblies 41 can be moved towards the respective drive roller assembly as seen in broken lines in FIG. 4. Each of the respective drive and guide roller assemblies 40 and 41 include keyed main support shafts 40A and 40B extending through multiple bearing elements 40B and 41B. Multiple pairs of rollers 43 and 44 are positioned on said respective support shafts 40A and 40B in spaced longitudinal alignment so that they can be adjusted and moved along the keyed support shafts 40A and 40B to conform to the engagement area of a heat exchanger tube bundle 45 to be positioned in horizontally aligned relation thereon.

Figure 6:
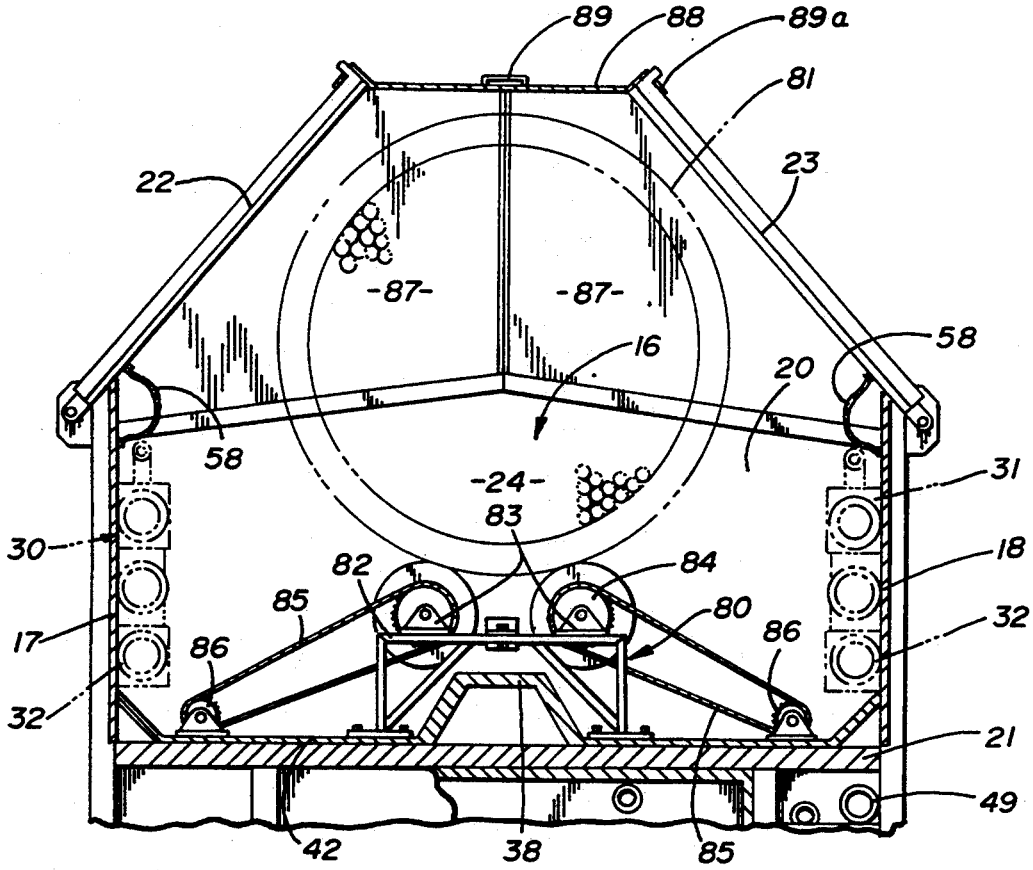
FIG. 6 is an end cross-sectional view of an alternate heat exchanger tube bundle cleaning device for cleaning large single tubular bundles.

The support and drive shafts 40A of the drive roller assemblies 40 are connected to respective hydraulic motors 40C within the circulation and filter sump 27, best seen in FIGS. 4 and 6.

Figure 2:
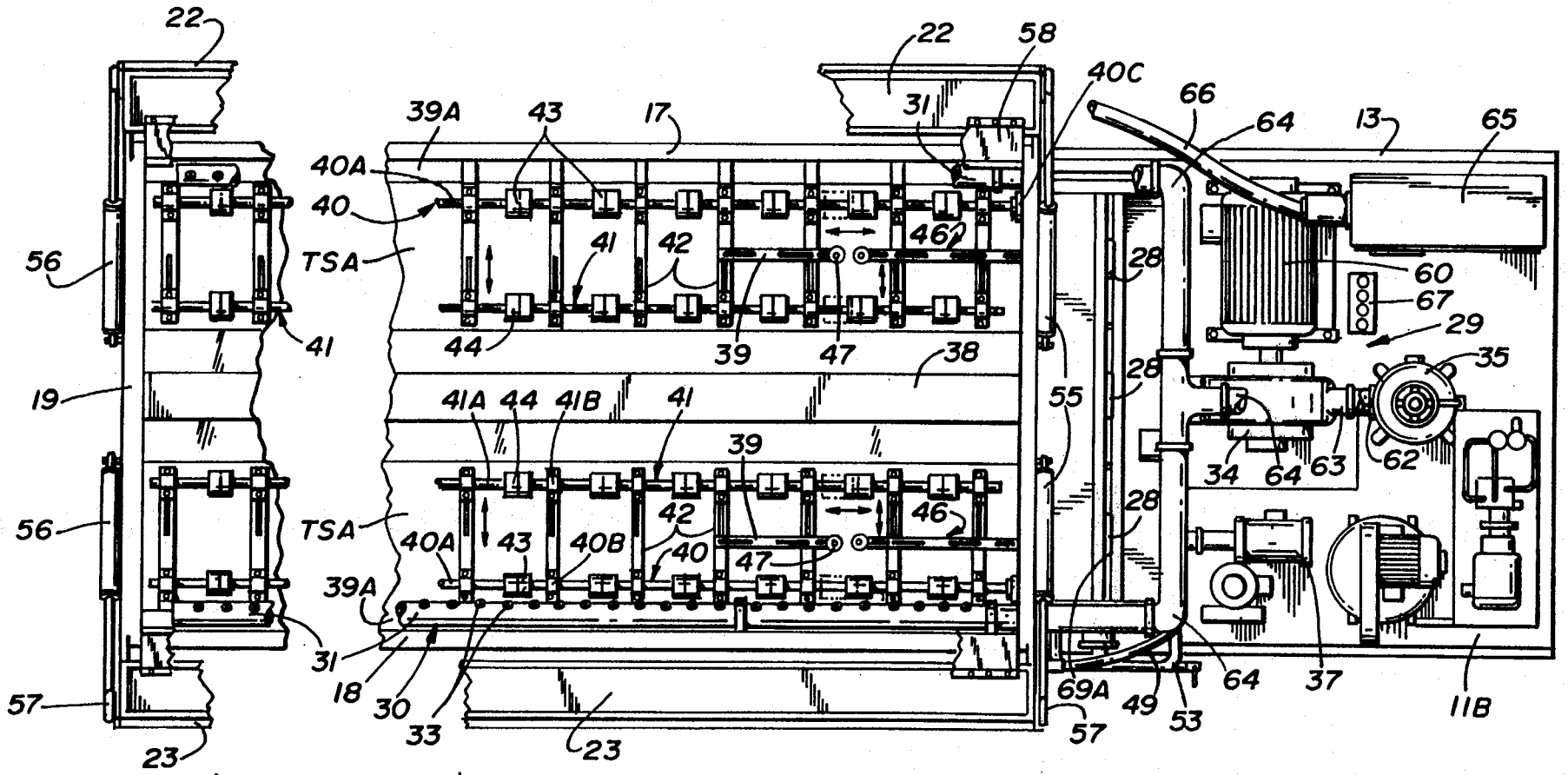
FIG. 2 is a top plan view of the heat exchanger tube bundle cleaning device with portions broken away.

Referring now to FIG. 2 of the drawings, thrust bearing assemblies 46 can be seen within the heat exchanger tube bundle receiving reservoir enclosure 16 between the respective drive and guide roller assemblies 40 and 41. Each of these thrust bearing assemblies 46 have a pair of longitudinally spaced adjustable bearing rollers 47 mounted horizontally on adjustable slotted support brackets 39 secured to the floor 21 between said drive and guide roller assemblies 40 and 41 adjacent the recirculation and filter sump 27.

The heat exchanger tube bundle 45 typically has an apertured end mounting plate 48 of an increased diameter that will register between said adjustable bearing rollers 47 of the thrust bearing assembly 46 positioning and holding the heat exchanger bundle 45 in longitudinal alignment during rotation by the drive roller assembly 40 as hereinbefore described.

Referring to FIG. 5 of the drawings, a graphic illustration of the fluid flow paths associated with the cleaning fluid are illustrated wherein the cleaning fluid supply reservoir 25 is connected to the secondary pump assembly 37 by multiple supply and return lines 49 and 50 and interconnected filter 51. Recirculation and filter sump supply lines 52 and 53 provide selected filling of the sump 27 and the interconnected heat exchanger tubular tube bundles reservoir enclosure 16 by a plurality of control and check valves 54 as will be well known and understood by those skilled in the art. This arrangement allows for initial heating and recirculation of the cleaning fluid from the cleaning fluid supply reservoir 25 through the filter 51 in a closed loop. Once the cleaning fluid is up to operating temperature the appropriate control valves 54 are activated to fill the sump 27 and interconnected heat exchanger tube bundle receiving reservoir enclosure 16. Referring to FIGS. 1–4 the doors 22 and 23 hereinbefore described each have a pair of hydraulic piston and cylinder assemblies 55 and 56 pivotally connected to closure plates 57 on respective opposing ends of each door. Each piston and cylinder assembly pair act together to open and close the respective doors 22 and 23 for insertion and removal of the heat exchanger tube bundle 45 within. Resilient splash skirts 58 extend longitudinally between the respective doors 22 and 23 and sidewalls 17 and 18 to prevent spray loss during use. A fume venting system 59 is provided to vent extraneous fumes within the enclosed area during use.

Referring to FIGS. 1 and 2 the second mobile base 11B can be seen on which is positioned the main pump and filter assembly 29 as hereinbefore described. The high volume filter 35 can be seen connected to a main pump 34 and interconnected motor 60. The high volume filter 35 has spaced vertical inlets and outlets 62 and 63. Filter screens (not shown) are positioned within a pressure vessel of the high volume filter 35 that is a modification of a commercially available filter strain assembly manufactured by W. M. Nugent and Company, model no. 1554-206B-SN150.

In operation, the tube bundles 45 are lowered into the heat exchange tube bundle receiving reservoir enclosure 16 and positioned on respective drive and guide roller assemblies 40 and 41 and thrust bearing assemblies 46 which have been adjusted to the required spacing for respective tube bundle as hereinbefore described. The doors 22 and 23 are closed defining the enclosed area. The cleaning fluid comprised of the two-part solution of DTE light oil and Mobilsola° flushing oil is heated within the cleaning fluid reservoir 25 by the plurality of heaters 25A positioned within and then pumped to the sump 27 partially filling the heat exchanger tubular bundle receiving reservoir enclosure 16 to the desired level partially submerging the respective heat exchange tube bundles 45 within. The main pump and motor assembly 29 circulates cleaning fluid from the sump 27 through a supply line 64 to the hereinbefore described manifolds 31 and 32 at approximately 110 lbs. per square inch. The spray nozzle assemblies 30 provides a continuous overlapping spray pattern on the heat exchange tube bundles 45 which are rotated on the multiple drive and guide roll assemblies 40 and 41. The cleaning fluid is thus circulated through the sump 27 and its primary filters 28 best seen in FIG. 2 of the drawings. Upon completion of the cleaning cycle which will vary depending on the size of heat exchanger tube bundles 45 and condition of same the cleaning fluid solution is drained back into the cleaning fluid storage reservoir 25 for future use.

It will be apparent to those skilled in the art that the heat exchanger tube bundles 45 are first cleaned internally by high pressure water and abrasive plugs (not shown) which are forced through the individual tubes as is available in common practice at the present time. Since, while in use the heat exchanger tube bundles 45 have cooling water circulating through them the build up of extraneous material within the tube bundles 45 is limited and easily removed by the high pressure wash and abrasive plug sequence. It is the coking of hot cooling oil that circulates around and through the exterior surface of the heat exchange tube bundles 45 that builds up on the exterior surface of same and reduces thermal transfer that diminishes the efficiency of the heat exchange tube bundles 45. Removal of the build up residue is critical requirement of the heat exchange tube bundles for continued high efficiency use as is required.

Hydraulic and electrical control for the heat exchange tube bundle cleaning apparatus are achieved by an electrical control panel 65 having a power supply cable 66 and a hydraulic control valve assembly 67.

It will be evident to those skilled in the art that various other operational equipment that is typically required is positioned on the secondary mobile base 11B such as air compressor 68, etc. as best seen in FIGS. 1 and 2 of the drawings.

Referring back to FIG. 1, the recirculation and filter sump 27 has an access door 69 which has been removed in FIG. 2 for illustration purposes only. The access door 69 allows the operator to remove and clean filter elements 28 which are removably positioned within a support framework 69A which separates the sump 27 and is positioned in spaced relation to an intake opening 70 within the sump.

Figure 7:
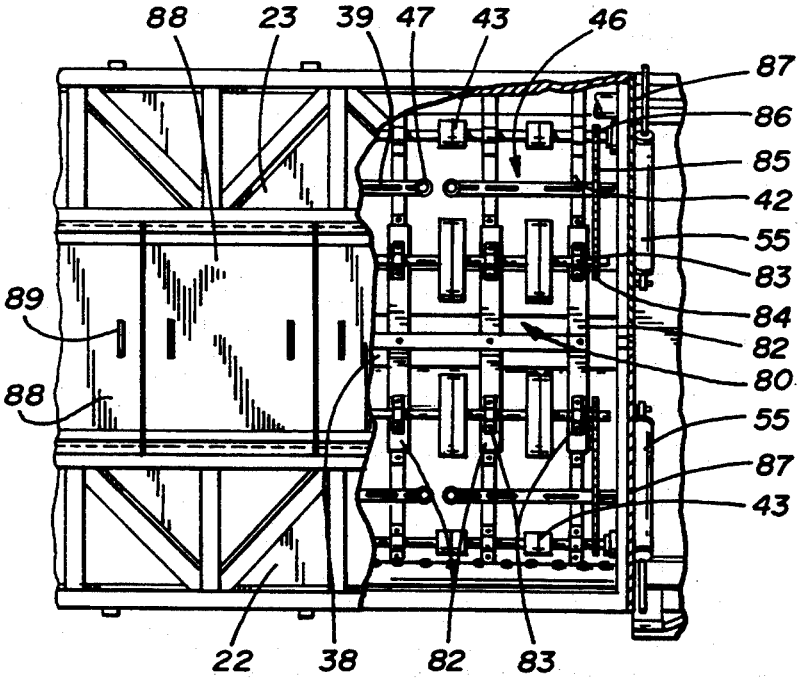
FIG. 7 is a top plan view of the alternate heat exchanger tube bundle cleaning device of FIG. 6 with portions broken away.

Referring now to FIGS. 6 and 7 of the drawings, an alternate drive roller assembly 80 can be seen for use with single large heat exchanger tube bundles 81 shown in broken lines in FIG. 6 which require a modified roller assembly and increased bundle receiving reservoir enclosure area 24. The alternate drive roller assembly 80 has a plurality of roller support brackets 82 which are secured to the guide channels 42 in place of the guide rollers 44 of the guide roller assembly 41. Secondary drive roller assemblies 83 are positioned in spaced horizontal relation to one another on said support bracket 82. Drive sprockets 84 on the secondary drive roller assembly 83 are driven by roller chains 85 thereon which extend to an adapter drive sprocket 86 keyed to the existing drive roller assemblies 43, seen in FIG. 6 of the drawings.

It will be evident from the above description that the secondary drive roller assemblies 83 allows for positioning and cleaning of the large heat exchanger tube bundle 81 within the receiving reservoir enclosure 24.

In order to enclose the heat exchanger tubular bundle 81, a door modification assembly is used and comprised of a pair of tapered end panel enclosures 87 that are positioned respectively on opposing end walls 19 and 20. The elongated doors 22 and 23 are pivoted partially open as illustrated in FIG. 6 to accommodate the increase tube bundle size. A plurality of door and closure cover plates 88 extend between the respective free ends of said doors completing the enclosure of the tube bundle within. Each of said door and closure cover plates 88 has oppositely disposed an angular disposed door engagement edges 89 that fit on the ends of the respective doors 22 and 23 bridging the gap therebetween. Handles 89 are positioned on the enclosure cover plates 88 to facilitate the placement and removing of same.

It will thus be seen that a new and useful self-contained mobile heat exchanger tube bundle cleaning apparatus has been illustrated and described and it will be apparent to those skilled in the art that various changes and modifications may be made therein without departing from the spirit of the invention, therefore

I claim:

1. An apparatus for cleaning heat exchanger tube bundles in a mobile self-contained enclosed environmentally isolated environment comprises in combination, a tube bundle receiving reservoir enclosure having a contoured bottom, upstanding opposing sidewalls and end walls, doors pivotally secured to said sidewalls, means for moving said doors in relation to said tubular bundle receiving reservoir enclosure, a cleaning fluid sump in communication with said tubular bundle receiving reservoir enclosure, drive and guide roller assemblies in said tubular bundle receiving reservoir enclosure to receive said heat exchanger tubular bundles, means for longitudinally adjusting said guide and drive rollers, and means for transversely adjusting said guide roller assembly in relation to said drive roller assembly, adjustable spray means within said tubular bundle receiving reservoir enclosure for spraying a cleaning fluid over the length of said heat exchanger tubular bundle, a main pump and filter assembly for recirculating said cleaning fluid from said sump to said adjustable spray means, a cleaning fluid supply reservoir interconnected with said sump, means for heating said cleaning fluid in said supply reservoir prior to recirculating through said main pump and filter assembly, thrust bearing assemblies in said tubular bundle receiving reservoir enclosure for engaging and guiding said heat exchanger tubular bundles during rotation within said tubular bundle receiving reservoir, means for controlling said drive roller assembly drive means, said main pump and filter assembly and said means for heating said cleaning fluid in said cleaning fluid supply reservoir.

2. The apparatus for cleaning heat exchanger tube bundles of claim 1 wherein said heat exchanger tube bundle receiving reservoir and said sump are on a first mobile base, and said main pump and filter assembly are on a second mobile base, said first and second mobile base are independently mounted on a truck trailer bed.

3. The apparatus for cleaning heat exchanger tube bundles of claim 1 wherein said contoured bottom of said tube bundle receiving reservoir enclosure comprises a centrally raised elongated center section and spaced oppositely disposed parallel inclined sidewall elements defining respective tube bundle receiving areas within said tubular bundle receiving reservoir.

4. The apparatus for cleaning heat exchanger tube bundles of claim 1 wherein said means for longitudinal adjustment of said drive rollers and guide roller assemblies comprises multiple independent rollers keyed to support axles.

5. The apparatus for cleaning heat exchanger tube bundles of claim 1 wherein said adjustable spray means comprises a plurality of longitudinally spaced spray nozzles in respective pairs of opposing vertically spaced parallel supply manifolds in manifold support brackets on said respective sidewalls.

6. The apparatus for cleaning heat exchanger tube bundles of claim 1 wherein said means for transverse adjustment of said guide roller assembly in relation to said drive roller assembly comprises, slotted brackets within said tube bundle receiving reservoir enclosure, said slotted brackets extending from said respective sidewalls on said contoured bottom to a raised center section on said contoured bottom, said raised center section defining two heat exchanger tubular bundle receiving areas within said tubular bundle receiving reservoir enclosure.

7. The apparatus for cleaning heat exchanger tubular bundles of claim 1 wherein said means for heating said cleaning fluid in said cleaning fluid supply reservoir comprises multiple heaters within said cleaning fluid supply reservoir and control means for said heaters.

8. The apparatus for cleaning heat exchanger tube bundles of claim 1 wherein said means for controlling said drive roller means, said main pump and filter assembly and said means for heating said cleaning fluid in said cleaning fluid supply reservoir comprises a control panel and control valving interconnected to a power source and a source of hydraulic fluid pressure therein.

9. The apparatus for cleaning heat exchanger tube bundles of claim 1 wherein said means for moving said tubular bundle receiving reservoir enclosure doors comprises pairs of hydraulic piston and cylinder assemblies extending from said opposite end walls of said tubular receiving reservoir enclosure to said tubular bundle receiving reservoir doors.

10. The apparatus for cleaning heat exchanger tube bundles of claim 1 wherein said cleaning fluids is comprised of a combination of 85% DTE light oil and 15% Mobilsola® flushing oil.

11. An apparatus for cleaning heat exchanger tube bundles in a mobile self-contained enclosed environmentally isolated environment comprises in combination, a tube bundle receiving reservoir enclosure having a contoured bottom, upstanding opposing sidewalls and endwalls, doors pivotally secured to said sidewalls, means for moving said doors in relation to said tubular bundle receiving reservoir enclosure, a cleaning fluid sump in communication with said tubular bundle receiving reservoir enclosure, drive roller assemblies and guide roller assemblies in said tubular bundle receiving reservoir enclosure to receive said heat exchanger tube bundle within said tubular bundle receiving reservoir, means for longitudinally adjusting said guide and drive roller assemblies and means for transversely adjusting said guide roller assemblies in relation to said drive roller assemblies, adjustable spray means within said tubular bundle receiving reservoir enclosure for spraying a cleaning fluid over the length of said heat exchanger tube bundle, a main pump and filter assembly for recirculating said cleaning fluid from said pump to said adjustable spray means, a cleaning fluid supply reservoir interconnecting with said sump, means for heating said cleaning fluid in said supply reservoir prior to recirculation through said main pump and filter assembly, a thrust bearing assembly in said tubular bundle receiving reservoir enclosure for engaging and guiding said heat exchanger tube bundle during rotation, means for controlling said drive roller assemblies, said main pump and filter assembly and said means for heating said cleaning fluid in said cleaning fluid supply reservoir, means for driving one of said drive roller assemblies independent of said first drive roller assembly, means for enclosing said tube bundle receiving reservoir between said doors and said sidewalls.

12. The apparatus for cleaning heat exchange tube bundle of claim 11 wherein said drive means comprises a sprocket and roller chain assembly extending between said respective drive roller assemblies.

13. The apparatus for cleaning heat exchanger tube bundle of claim 11 wherein said means for enclosing said tube bundle receiving reservoir between said doors comprises a plurality of door enclosure cover plates extending in end to end relation between said doors and multiple pairs of oppositely disposed tapered side panel enclosures positioned on said respective end walls and engaging said doors and said door enclosure cover plates therebetween.

* * * * *